US005638792A

United States Patent [19]

Ogawa et al.

[11] Patent Number: 5,638,792

[45] Date of Patent: Jun. 17, 1997

[54] CONTROL SYSTEM FOR INTERNAL COMBUSTION ENGINES

[75] Inventors: Ken Ogawa; Yoshikazu Oshima, both of Wako, Japan

[73] Assignee: Honda Giken Kogyo K.K., Tokyo, Japan

[21] Appl. No.: 313,442

[22] Filed: Sep. 27, 1994

[30] Foreign Application Priority Data

Sep. 29, 1993 [JP] Japan ..... 5-265803

[51] Int. Cl.[6] ..... F02D 41/04

[52] U.S. Cl. ..... 123/480

[58] Field of Search ..... 123/480, 478

[56] References Cited

U.S. PATENT DOCUMENTS 5,086,744 2/1992 Ishihara et al. ..... 123/480

5,215,061 6/1993 Ogawa et al. ..... 123/478

FOREIGN PATENT DOCUMENTS 5-340285 12/1993 Japan ..... 123/480

*Primary Examiner*—Andrew M. Dolinar

*Attorney, Agent, or Firm*—Arthur J. Lessler

[57] ABSTRACT

A control system for an internal combustion engine comprises an ECU which calculates an amount of fuel to be supplied to the engine and determines a direct supply ratio and a carry-off ratio, based on operating conditions of the engine. The direct supply ratio is a ratio of a fuel amount directly drawn into the engine in a predetermined operating cycle of the engine to the whole fuel amount injected in the same operating cycle, and the carry-off ratio is a ratio of a fuel amount carried off the inner surface of the intake pipe and drawn into the engine in the predetermined operating cycle to the whole fuel amount which adhered to the inner surface of the intake pipe in an operating cycle immediately preceding the predetermined operating cycle. An adherent fuel amount which is to adhere to the intake pipe inner surface in the predetermined operating cycle is estimated based on the direct supply ratio and the carry-off ratio, and the carried-off fuel amount is estimated based on the direct supply ratio and the adherent fuel amount. The supply fuel amount is corrected based on the estimated adherent fuel amount and carried-off fuel amount, and then the corrected fuel amount is injected into the engine. The direct supply ratio and the carry-off ratio are corrected when the two ratios are in a predetermined relationship.

7 Claims, 12 Drawing Sheets

CONTROL SYSTEM FOR INTERNAL COMBUSTION ENGINES

BACKGROUND OF THE INVENTION

1. Field of the Invention

This invention relates to a control system for internal combustion engines, which controls the supply of fuel injected into an intake pipe of the engine in a manner compensating for a fuel amount adhering to the inner surface of the intake pipe.

2. Prior Art

In conventional internal combustion engines of the type that fuel is injected into an intake pipe, there is a problem that some of injected fuel adheres to the inner surface of the intake pipe, so that a required amount of fuel cannot be drawn into the combustion chamber. To solve this problem, there has been proposed a fuel supply control method (adherence correction) by Japanese Provisional Patent Publication (Kokai) No. 61-126337, which estimates a fuel amount which is to adhere to the inner surface of the intake pipe and one which is to be drawn into the combustion chamber by evaporation from the fuel adhering to the intake pipe, and determines a fuel injection amount in dependence on the estimated fuel amounts.

Further, conventionally internal combustion engines are known, for example, from Japanese Patent Publication (Kokoku) No. 2-50285, in which operating characteristics of intake valves and exhaust valves of the engine, i.e. valve timing (valve opening/closing timing and/or valve lift) are changeable.

Furthermore, to apply the above-mentioned control method to the above-mentioned type internal combustion engines, a method has been already proposed by the present assignee by Japanese Provisional Patent Publication (Kokai) No. 5-99030 and U.S. Pat. No. 5,215,061 corresponding thereto, which can accurately control the air-fuel ratio of a mixture supplied to the engine by correcting an adherent fuel amount and a carried-off fuel amount in accordance with operating characteristics of intake valves and/or exhaust valves of the engine.

According to the above proposed adherence-correcting method, the adherent fuel amount and the carried-off fuel amount are calculated by the use of a direct supply ratio A and a carry-off ratio B in the following manner: The direct supply ratio A is defined as a ratio of a fuel amount directly or immediately drawn into a combustion chamber in an operating cycle of the engine to the whole fuel amount injected in the same operating cycle, and the carry-off ratio B is defined as a ratio of a fuel amount carried off the inner surface of the intake pipe by evaporation, etc. and drawn into the combustion chamber in the present operating cycle to the whole fuel amount which adhered to the inner surface of the intake pipe in the last or immediately preceding operating cycle. The adherent fuel amount is estimated based on the direct supply ratio A and the carry-off ratio B, and the carried-off fuel amount is estimated based on the carry-off ratio B and the above estimated adherent fuel amount. The direct supply ratio A and the carry-off ratio B are determined based on a plurality of parameters which are closely related to the adherence correction, such as engine coolant temperature, engine rotational speed, and intake pipe absolute pressure.

In the above adherence-correcting method, however, the direct supply ratio A and the carry-off ratio B are parameters calculated independently of each other, and the adherence correction of the fuel injection amount is carried out without taking into account the relationship between the direct supply ratio A and the carry-off ratio B. As a result, an inconvenience can sometimes occur depending on the above relationship.

For example, when the relationship of A<B stands, the fuel injection amount after the adherence correction converges to a desired value while fluctuating. Consequently, the air-fuel ratio of a mixture supplied to the engine can deviate from a desired air-fuel ratio due to the fluctuation of the fuel injection amount, resulting in degraded exhaust emission characteristics and degraded drivability of the engine.

SUMMARY OF THE INVENTION

It is the object of the invention to provide a control system for internal combustion engines, which is capable of more accurately controlling the air-fuel ratio of a mixture supplied to the engine by taking into consideration the direct supply ratio and the carry-off ratio during execution of the adherence correction.

To attain the above object, the present invention provides a control system for an internal combustion engine having an intake passage having an inner surface, comprising:

supply fuel amount-calculating means for calculating an amount of fuel to be supplied to the engine, based on operating conditions of the engine;

direct supply ratio/carry-off ratio-determining means for determining a direct supply ratio and a carry-off ratio, based on operating conditions of the engine, the direct supply ratio being a ratio of a fuel amount directly drawn into the engine in a predetermined operating cycle of the engine to a fuel amount supplied into the intake passage in the same operating cycle, the carry-off ratio being a ratio of a fuel amount carried off the inner surface of the intake passage and drawn into the engine in the predetermined operating cycle of the engine to a fuel amount which adhered to the inner surface of the intake passage in an operating cycle immediately preceding the predetermined operating cycle;

adherent fuel amount-estimating means for estimating an adherent fuel amount which is to adhere to the inner surface of the intake passage in the predetermined operating cycle of the engine, based on the direct supply ratio and the carry-off ratio;

carried-off fuel amount-estimating means for estimating the fuel amount carried off the inner surface of the intake passage, based on the direct supply ratio and the adherent fuel amount;

supply fuel amount-correcting means for correcting the amount of fuel to be supplied, calculated by the supply fuel amount-calculating means, based on the adherent fuel amount estimated by the adherent fuel amount-estimating means and the carried-off fuel amount estimated by the carried-off fuel amount-estimating means;

fuel supply means for supplying fuel in the fuel amount corrected by the supply fuel amount-correcting means; and direct supply ratio/carry-off ratio-correcting means for correcting the direct supply ratio and the carry-off ratio when the direct supply ratio and the carry-off ratio are in a predetermined relationship.

Preferably, the predetermined relationship is satisfied when the carry-off ratio is larger than the direct supply ratio.

In a preferred embodiment of the invention, the direct supply ratio/carry-off ratio-correcting means corrects the direct supply ratio and the carry-off ratio by the use of the following equations:

$$Ae=(Be+\alpha-\alpha Ae)/(1-Ae+Be)$$

$$Be=Ae-\alpha$$

$$0<\alpha<1$$

where Ae represents the direct supply ratio, Be the carry-off ratio, and α a correction coefficient.

Preferably, the correction coefficient α used in the equations is set to a fixed value in a range more than 0 and less than 1.

Also preferably, the engine includes at least one intake valve, at least one exhaust valve, and valve timing changing means for changing valve timing of at least one of the at least one intake valve and the at least one exhaust valve, the direct supply ratio/carry-off ratio-detecting means determining the direct supply ratio and the carry-off ratio, based on the valve timing of the at least one of the at least one intake valve and the at least one exhaust valve.

To attain the same object, the present invention also provides a control system for an internal combustion engine having an intake passage having an inner surface, comprising:

supply fuel amount-calculating means for calculating an amount of fuel to be supplied to the engine, based on operating conditions of the engine;

direct supply ratio/carry-off ratio-determining means for determining a direct supply ratio and a carry-off ratio, based on operating conditions of the engine, the direct supply ratio being a ratio of a fuel amount directly drawn into the engine in a predetermined operating cycle of the engine to a fuel amount supplied into the intake passage in the same operating cycle, the carry-off ratio being a ratio of a fuel amount carried off the inner surface of the intake passage and drawn into the engine in the predetermined operating cycle of the engine to a fuel amount which adhered to the inner surface of the intake passage in an operating cycle immediately preceding the predetermined operating cycle;

supply fuel amount-correcting means for correcting the amount of fuel to be supplied, calculated by the supply fuel amount-calculating means, based on the direct supply ratio and the carry-off ratio determined by the direct supply ratio/carry-off ratio-determining means;

fuel supply means for supplying fuel in the fuel amount corrected by the supply fuel amount-correcting means; and direct supply ratio/carry-off ratio-correcting means for correcting the direct supply ratio and the carry-off ratio when the direct supply ratio and the carry-off ratio are in a predetermined relationship.

Preferably, the predetermined relationship is satisfied when the carry-off ratio is larger than the direct supply ratio.

The above and other objects, features, and advantages of the invention will be more apparent from the following detailed description taken in conjunction with the accompanying drawings.

DETAILED DESCRIPTION

The invention will now be described in detail with reference to the drawings showing embodiments thereof.

Figure 1:
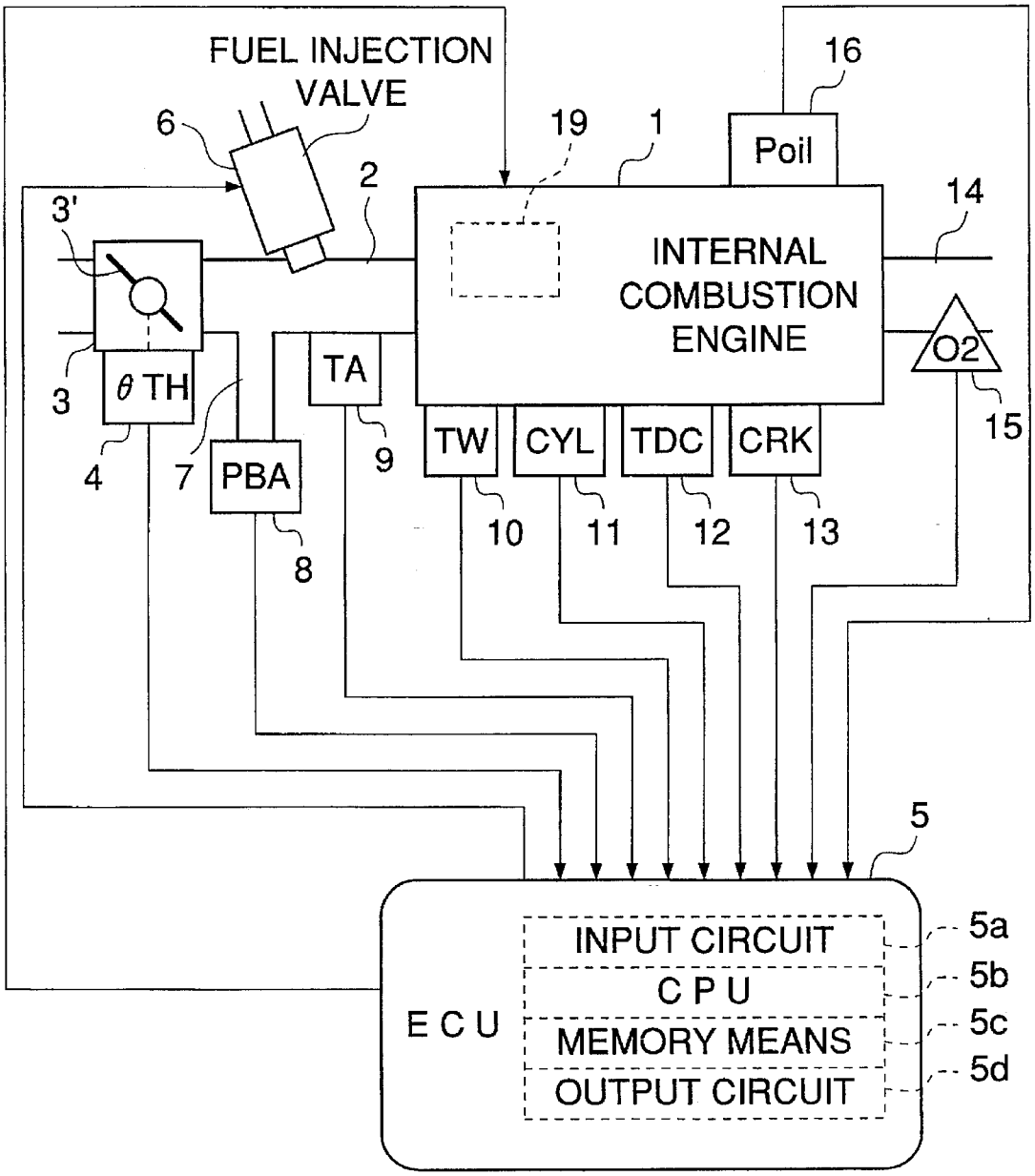
FIG. 1 is a schematic diagram showing the whole arrangement of an internal combustion engine and a control system therefor, according to a first embodiment of the invention.

Referring first to FIG. 1, there is illustrated the whole arrangement of an internal combustion engine and a control system therefor, according to a first embodiment of the invention.

In the figure, reference numeral 1 designates a DOHC straight type four-cylinder internal combustion engine (hereinafter simply referred to as "the engine"), each cylinder being provided with a pair of intake valves and a pair of exhaust valves, not shown. The engine 1 has a valve timing changeover mechanism 19 which can change over valve timing of the intake valves and exhaust valves between two stages of high-speed valve timing (high-speed V/T) suitable for operation of the engine in a high rotational speed region and low-speed valve timing (low-speed V/T) suitable for operation of the engine in a low rotational speed region. The changeover of the valve timing in the present embodiment includes changeover of valve lift of the intake and/or exhaust valves.

In an intake pipe 2 of the engine 1, there is arranged a throttle body 3 accommodating a throttle valve 3' therein. A throttle valve opening (θTH) sensor 4 is connected to the throttle valve 3' for generating an electric signal indicative of the sensed throttle valve opening and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3'. The fuel injection valves 6 are connected to a fuel pump, not shown, and electrically connected to the ECU 5 to have their valve opening periods controlled by signals therefrom.

An intake pipe absolute pressure (PBA) sensor 8 is provided in communication with the interior of the intake pipe 2 via a conduit 7 opening into the intake pipe 2 at a location downstream of the throttle valve 3', for supplying an electric signal indicative of the sensed absolute pressure PBA within the intake pipe 2 to the ECU 5.

An intake air temperature (TA) sensor 9 is mounted in the inner wall of the intake pipe 2 at a location downstream of the conduit 7, for supplying an electric signal indicative of the sensed intake air temperature TA to the ECU 5.

An engine coolant temperature (TW) sensor 10 formed of a thermistor or the like is inserted into a coolant passage filled with a coolant and formed in the cylinder block, for supplying an electric signal indicative of the sensed engine coolant temperature TW to the ECU 5.

Further, a cylinder-discriminating (CYL) sensor 11, a TDC sensor 12, and a crank angle (CRK) sensor 13 are arranged in facing relation to a camshaft or a crankshaft of the engine 1, neither of which is shown, at respective predetermined locations along the shaft.

The CYL sensor 11 generates a pulse (hereinafter referred to as "a CYL signal pulse") at a predetermined crank angle of a particular cylinder of the engine whenever the crankshaft rotates two rotations, and supplies the CYL signal pulse to the ECU 5.

The TDC sensor 12 generates a pulse (hereinafter referred to as "a TDC signal pulse") at each of predetermined crank angles whenever the crankshaft rotates through 180 degrees, and supplies the TDC signal pulse to the ECU 5.

The CRK sensor 13 generates pulses (hereinafter referred to as "CRK signal pulses") at predetermined crank angles with a repetition period shorter than the repetition period of TDC signal pulses (e.g. whenever the crankshaft rotates through 30 degrees), the CRK signal pulses being supplied to the ECU 5.

The output signal pulses from the CYL sensor 11, TDC sensor 12 and CRK sensor 13 are used for control of various kinds of timing, such as fuel injection timing and ignition timing, as well as detection of the engine rotational speed NE.

Further, an oxygen concentration sensor (hereinafter referred to as "the O2 sensor") 15 is arranged in an exhaust pipe 14 of the engine 1, for supplying an electric signal indicative of the sensed oxygen concentration present in exhaust gases to the ECU 5.

The valve timing changeover mechanism 19 has a solenoid valve, not shown, for controlling changeover of the valve timing and is electrically connected to the ECU 5 to have its valving operation controlled by a signal from the ECU 5. The solenoid valve changes operating oil pressure for the valve timing changeover mechanism 19 from a high level to a low level or vice versa, so that the valve timing is changed over from the high-speed V/T to the low-speed V/T or vice versa. The oil pressure in the changeover mechanism 19 is detected by an oil pressure (Poil) sensor 16, and the sensed oil pressure signal is supplied to the ECU 5.

The ECU 5 is comprised of an input circuit **5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* formed of a ROM storing various operational programs which are executed by the CPU 5*b*, and various maps and tables, referred to hereinafter, and a RAM for storing results of calculations therefrom, etc., and an output circuit 5*d* which outputs driving signals to the fuel injection valves 6, the solenoid valve of the changeover mechanism 19**, etc.

Figure 2A:
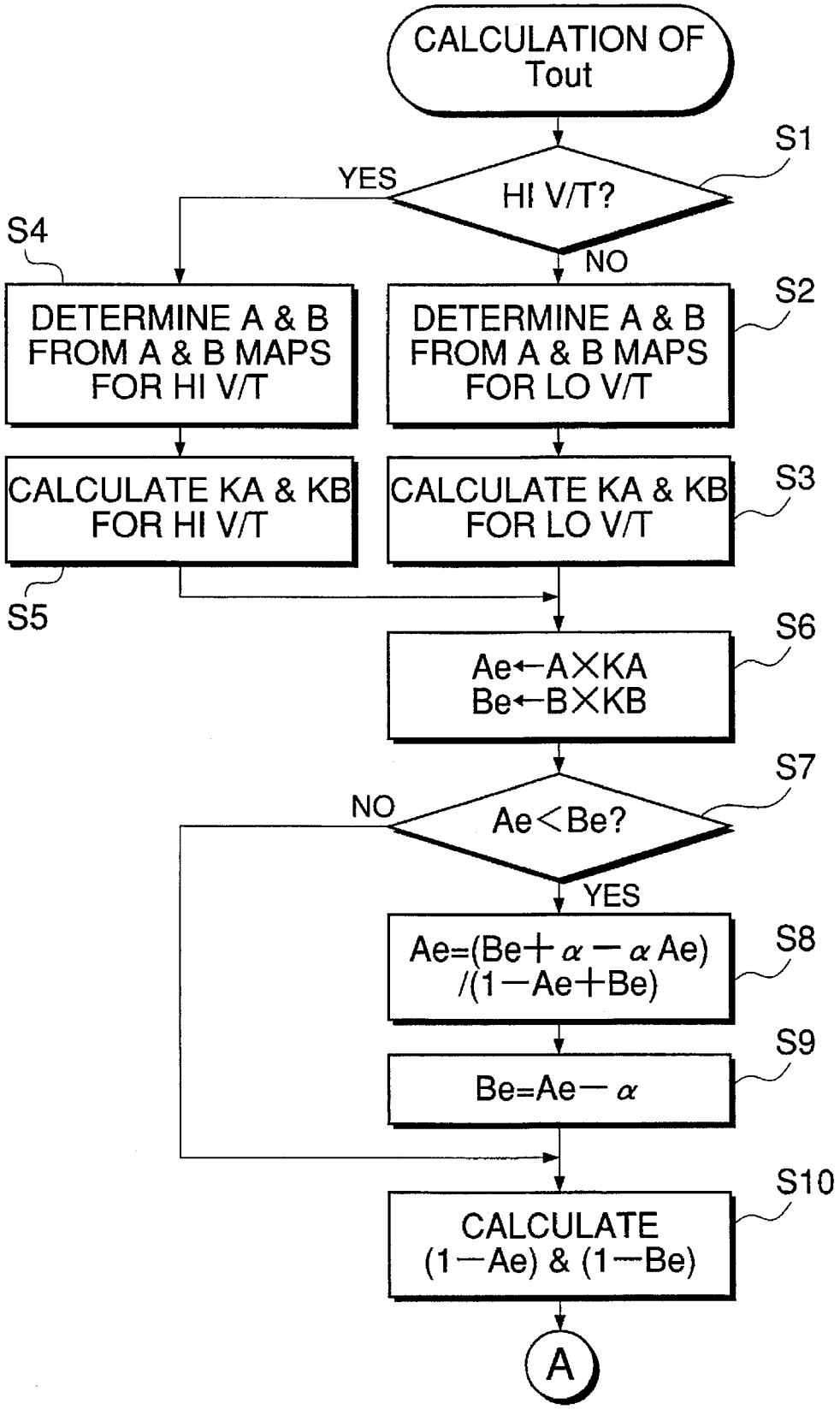
FIG. 2A is a flowchart showing a program for calculating a fuel injection period Tout, according to the first embodiment.
Figure 2B:
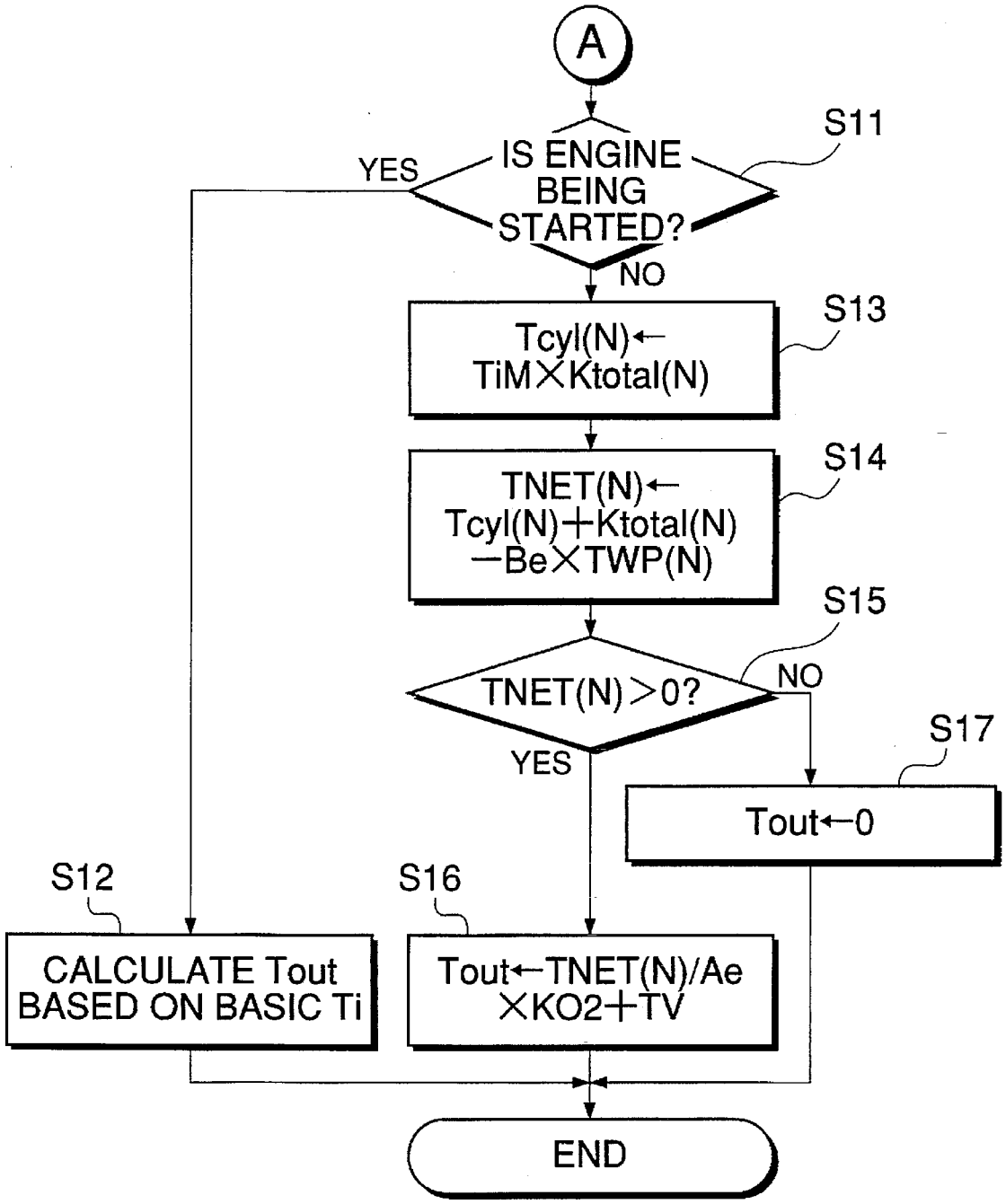
FIG. 2B is a continued part of the flowchart of FIG. 2A.

FIGS. 2A and 2B show a program for calculating a valve opening period of the fuel injection valves, i.e. a fuel injection amount Tout. This program is executed upon generation of each TDC signal pulse and in synchronism therewith.

At a step S1, it is determined whether or not the high-speed V/T is selected. If the answer is negative (NO), i.e. if the low-speed V/T is selected, a direct supply ratio A and a carry-off ratio B for the low-speed V/T are calculated at a step S2.

The direct supply ratio A is defined as a ratio of a fuel amount directly or immediately drawn into a combustion chamber in an operating cycle of the engine to the whole fuel amount injected in the same operating cycle, the direct supply ratio including a fuel amount carried off the inner surface of the intake pipe 2 by evaporation, etc., in the same operating cycle. The carry-off ratio B is defined as a ratio of a fuel amount carried off the inner surface of the intake pipe 2 by evaporation, etc. and drawn into the combustion chamber in the present operating cycle to the whole fuel mount which adhered to the inner surface of the intake pipe 2 in the last or immediately preceding operating cycle. The direct supply ratio A and the carry-off ratio B are read, respectively, from an A map and a B map for the low-speed V/T, which are set in accordance with coolant temperature TW and intake pipe absolute pressure PBA, based on the detected TW and PBA values.

Figure 4A:
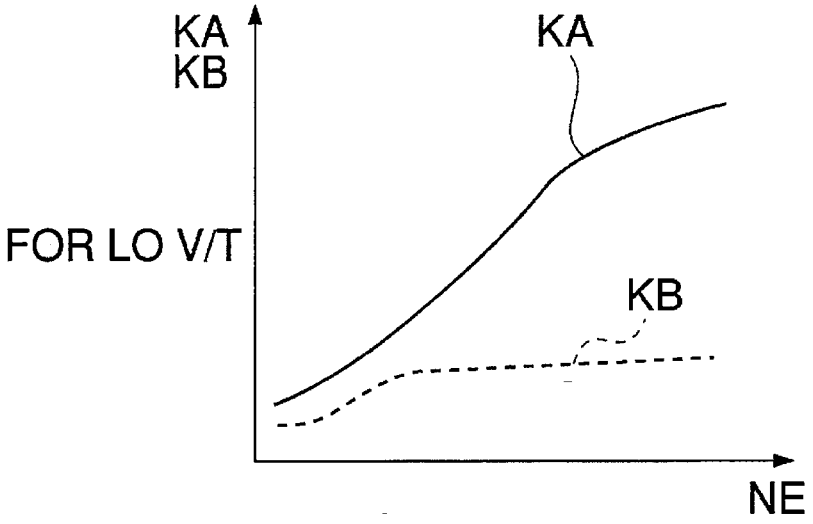
FIG. 4A shows a table for calculating correction coefficients for correcting a direct supply ratio A and a carry-off ratio B at low-speed valve timing (V/T)

At the following step S3, correction coefficients KA and KB for correcting the direct supply ratio A and the carry-off ratio B for the low-speed V/T are calculated. Values of the correction coefficients KA and KB are read from a KA table and a KB table for the low-speed V/T, shown in FIG. 4A, based on the engine rotational speed NE. In the KA and KB tables, the correction coefficient KA for the direct supply ratio A and the correction coefficient KB for the carry-off ratio B are set such that they increase as the engine rotational speed NE increases.

The reason why the correction coefficients KA and KB are thus set to increased values as the engine rotational speed NE increases is that the direct supply ratio A and the carry-off ratio B apparently increase as the intake air flow speed in the intake pipe increases with an increase in the engine rotational speed NE.

Figure 4B:
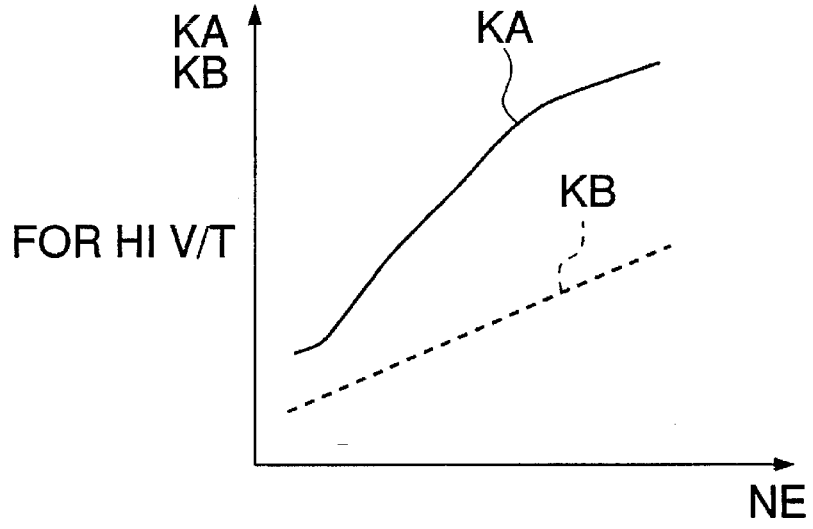
FIG. 4B shows a table similar to the FIG. 4A table, applied at high-speed V/T.

If the answer at the step S1 is affirmative (YES), similarly to the steps S2 and S3, a direct supply ratio A and a carry-off ratio B, and correction coefficients KA and KB for the high-speed V/T are calculated at steps S4 and S5, followed by the program proceeding to a step S6. At the step S4, the direct supply ratio A and the carry-off ratio B for the high-speed V/T are read from an A map and a B map for the high-speed V/T, respectively, and at the step S5, correction coefficients KA and KB for the high-speed V/T are calculated by the use of a KA table and a KB table for the high-speed V/T, respectively, as shown in FIG. 4B.

As mentioned above, according to the present embodiment, two kinds of the A maps and B maps as well as two kinds of correction coefficients KA and KB are provided, respectively, for the high-speed V/T and low-speed V/T. The reason for this is that the air flow speed in the vicinity of the intake valve and variation in pressure within the intake pipe 2 resulting from the air flow speed, which are factors of fuel transportation parameters, differ depending upon the valve opening and/or closing timing and valve lift of the intake valves. Accordingly, the direct supply ratio A and the carry-off ratio B both vary depending on the valve timing of the intake valves. Therefore, the A map, B map, KA table and KB table have been set with the above-mentioned fact taken into account.

At the following step S6, a corrected direct supply ratio Ae and a corrected carry-off ratio Be are calculated by the use of the following equations (1) and (2), followed by the program proceeding to a step S7:

$$Ae=A\times KA \quad (1)$$

$$Be=B\times KB \quad (2)$$

The step S7, and steps S8 and S9 perform processings according to an essential feature of the invention. At the step S7, it is determined whether or not a relationship of Ae<Be is satisfied. If the answer is affirmative (YES), the program proceeds to the step S8 and then to the step S9, wherein the Ae and Be values are corrected in manners indicated by the following equations (3) and (4), followed by the program proceeding to a step S10:

$$Ae=(Be+\alpha-\alpha Ae) \quad (3)$$

$$Be=Ae-\alpha \quad (4)$$

wherein $0<\alpha<1$

As mentioned above, the Ae and Be values are determined based on the engine coolant temperature TW, the intake pipe absolute pressure PBA, and the engine rotational speed NE. However, the relationship of Ae<Be can sometimes stands. If the relationship of Ae<Be stands, as mentioned before, the fuel injection amount obtained by the adherence correction fluctuates before it converges to a desired value, so that the air-fuel ratio of a mixture supplied to the engine becomes unstable. To prevent the satisfaction of the relationship of Ae<Be, according to the present embodiment, the Ae and Be values are corrected by the above equations (3) and (4). In this correction, to afford a little margin to the corrected values, a coefficient $\alpha$ in a range more than 0 and less than 1 is employed. The coefficient $\alpha$ is a fixed value, e.g. approximately 0.05.

By virtue of the above correction, the Ae and Be values can always satisfy the relationship of Ae>Be, and therefore the air-fuel ratio of the mixture can be stably controlled to a desired value without deviation, thereby preventing degraded exhaust emission characteristics and degraded drivability of the engine.

On the other hand, if the answer to the question of the step S7 is negative (NO), i.e. if Ae≧Be stands, the program skips over the steps S8 and S9 to the step S10.

At the step S10, values (1−Ae) and (1−Be) are calculated, and the program proceeds to a step S11 of FIG. 2B. The Ae, (1−Ae), and (1−Be) values are stored into the RAM of the ECU 5 to be used in execution of a program of FIG. 3, hereinafter described.

At the step S11, it is determined whether or not the engine is being started. If the answer is affirmative (YES), the fuel injection amount Tout is calculated based on a basic fuel amount Ti for use at the start of the engine, at a step S12, followed by terminating the program. If the answer to the question of the step S11 is negative (NO), i.e. if the engine is not being started, a required fuel amount Tcyl(N) for each cylinder, which does not include an additive correction term Ttotal, referred to hereinafter, is calculated by the use of the following equation (5), at a step S13:

$$Tcyl(N)=TiM\times Ktotal(N) \quad (5)$$

where (N) represents a number allotted to the cylinder for which the required fuel amount Tcyl is calculated, and TiM represents a basic fuel amount which is applied when the engine is under normal operating conditions (i.e. other than the starting condition) and calculated based on the engine rotational speed NE and the intake pipe absolute pressure PBA. Ktotal(N) represents the product of all correction coefficients (e.g. a coolant temperature-dependent correction coefficient KTW and a leaning correction coefficient KLS) which are calculated based on engine operating parameter signals from various sensors excluding an air-fuel ratio correction coefficient KO2 which is calculated based on an output signal from the O2 sensor 15.

At a step S14, a combustion chamber supply fuel amount TNET, which should be supplied to the corresponding combustion chamber in the present injection cycle, is calculated by the use of the following equation (6):

$$TNET=Tcyl(N)+Ttotal-Be\times TWP(N) \quad (6)$$

where Ttotal represents the sum of all additive correction terms (e.g. an acceleration fuel-increasing correction term TACC), which is calculated based on engine operating parameter signals from various sensors. The value Ttotal does not include an ineffective time correction term TV, referred to hereinafter. TWP(N) represents an intake pipe-adherent fuel amount (estimated value), which is calculated by the program of FIG. 3. (Be×TWP(N)) corresponds to an amount of fuel, which is evaporated from fuel adhering to the inner surface of the intake pipe 2 and carried into the combustion chamber. A fuel amount corresponding to the fuel amount (Be×TWP(N)) carried off the intake pipe inner surface need not be injected, and therefore is subtracted from the value Tcyl(N) in the equation (6).

At a step S15, it is determined whether or not the value TNET calculated by the equation (6) is larger than a value of 0. If the answer is negative (NO), i.e. if TNET≧0, the fuel injection amount Tout is set to 0, followed by terminating the program. If the answer to the question of the step S15 is affirmative (YES), i.e. if TNET>0, the Tout value is calculated by the use of the following equation (7):

$$Tout=TNET(N)Ae\times KO2+TV \quad (7)$$

where KO2 represents the aforesaid air-fuel ratio correction coefficient calculated in response to the output from the O2 sensor 15. TV represents the aforesaid ineffective time correction term.

Thus, a fuel amount corresponding to (TNET(N)×KO2+Be×TWP(N)) is supplied to the combustion chamber by opening the fuel injection valve 6 over the time period Tout calculated by the equation (7).

Figure 3:
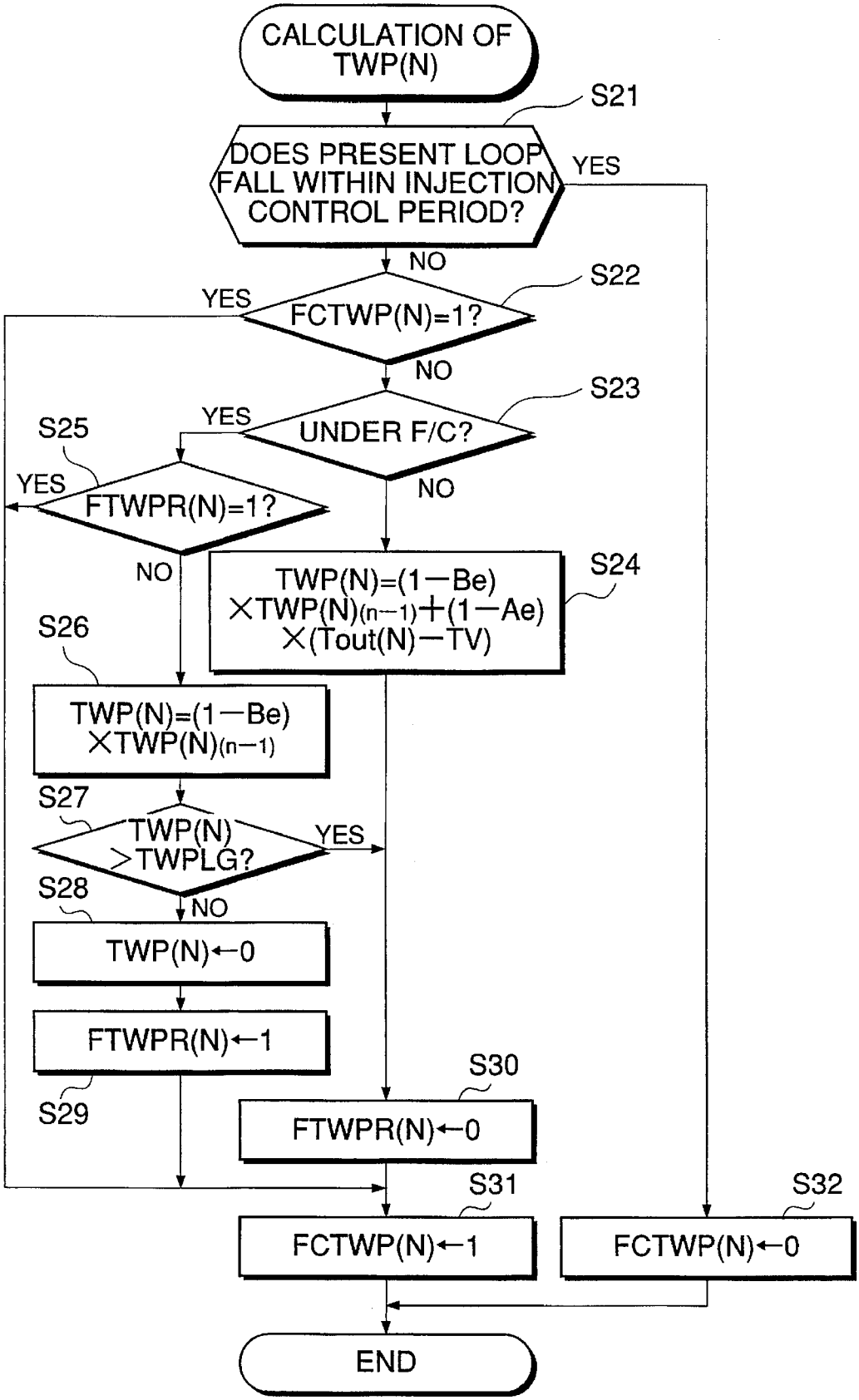
FIG. 3 is a flowchart showing a program for calculating an intake pipe-adherent fuel amount TWP(N)

FIG. 3 shows a program for calculating the intake pipe-adherent fuel amount TWP(N), which is executed upon generation of each crank angle pulse which is generated whenever the crankshaft rotates through a predetermined angle (e.g. 30 degrees).

At a step S21, it is determined whether or not the present loop of execution of this program falls within a time period after the start of calculation of the fuel injection amount Tout and before the completion of the fuel injection (hereinafter referred to as "the injection control period"). If the answer is affirmative (YES), a first flag FCTWP(N) is set to a value of 0 at a step S32, followed by terminating the program. If the answer to the question of the step S21 is negative (NO), i.e. if the present loop is not within the injection control period, it is determined at a step S22 whether or not the first flag FCTWP(N) is equal to 1. If the answer is affirmative (YES), that is, if FCTWP(N)=1, the program jumps to a step S31, whereas if the answer is negative (NO), i.e. if FCTWP (N)=0, it is determined at a step S23 whether or not the engine is under fuel cut (the fuel supply is interrupted).

If the answer to the question of the step S23 is negative (NO), i.e. if the engine is not under fuel cut, the intake pipe-adherent fuel amount TWP(N) is calculated at a step S24 by the use of the following equation (8), then a second flag FTWPR(N) is set to a value of 0 at a step S30, and the first flag FCTWP(N) is set to a value of 1 at a step S31, followed by terminating the program:

$$TWP(N)=(1-Be)\times TWP(N)(n-1)+(1-Ae)\times(Tout(N)-TV) \quad (8)$$

where TWP(N)(n−1) represents an immediately preceding value of TWP(N) obtained on the last occasion, and Tout(N) an updated or new value of the fuel injection amount Tout which has just been calculated by the program of FIGS. 2A and 2B. The first term on the right side corresponds to a fuel amount remaining on the inner surface of the intake pipe 2 without being carried into the combustion chamber, out of the fuel previously adhering to the inner surface of the intake pipe 2, and the second term on the right side corresponds to a fuel amount newly adhering to the inner surface of the intake pipe 2 out of newly injected fuel.

If the answer at the step S23 is affirmative (YES), i.e. if the engine is under fuel cut, it is determined at a step S25 whether or not the second flag FTWPR(N) has been set to a value of 1. If the answer is affirmative (YES), i.e. if FTWPR(N)=1, the program jumps to the step S31. If the answer is negative (NO), i.e. if FTWPR(N)=0, the adherent fuel amount TWP(N) is calculated by the use of the following equation (9) at a step S26, and then the program proceeds to a step S27:

$$TWP(N)=(1-Be)\times TWP(N)(n-1) \quad (9)$$

The equation (9) is identical with the equation (1), except that the second term on the right side is omitted. The reason for the omission is that there is no fuel newly adhering to the intake pipe inner surface, due to fuel cut.

At the step S27, it is determined whether or not the calculated TWP(N) value is larger than a very small predetermined value TWPLG. If the answer is affirmative (YESi, i.e. if TWP(N)>TWPLG, the program proceeds to the step S30. If the answer is negative (NO), i.e. if TWP (N)≧TWPLG, the TWP (N) value is set to a value of 0 at a step S28, and then the second flag FTWPR(N) is set to 1 at a step S29, followed by the program proceeding to the step S31.

According to the program of FIG. 3 described above, the intake pipe-adherent fuel amount TWP(N) can be accurately calculated. Moreover, by applying the thus calculated TWP (N) value to the calculation of the fuel injection amount Tout in the program of FIGS. 2A and 2B, an appropriate amount of fuel can be supplied to the combustion chamber of each cylinder, which reflects the fuel amount adhering to the inner surface of the intake pipe 2 as well as the fuel amount carried off the amount of the adherent fuel.

Further, according to the present embodiment, the direct supply ratio A and the carry-off ratio B are calculated and corrected in response to the selected valve timing, and therefore the effect of the intake pipe adherent fuel amount can be correctly estimated, irrespective of the valve timing selected. As a result, the air-fuel ratio of a mixture supplied to the combustion chamber of each cylinder can be accurately controlled to a desired value.

Figure 5:
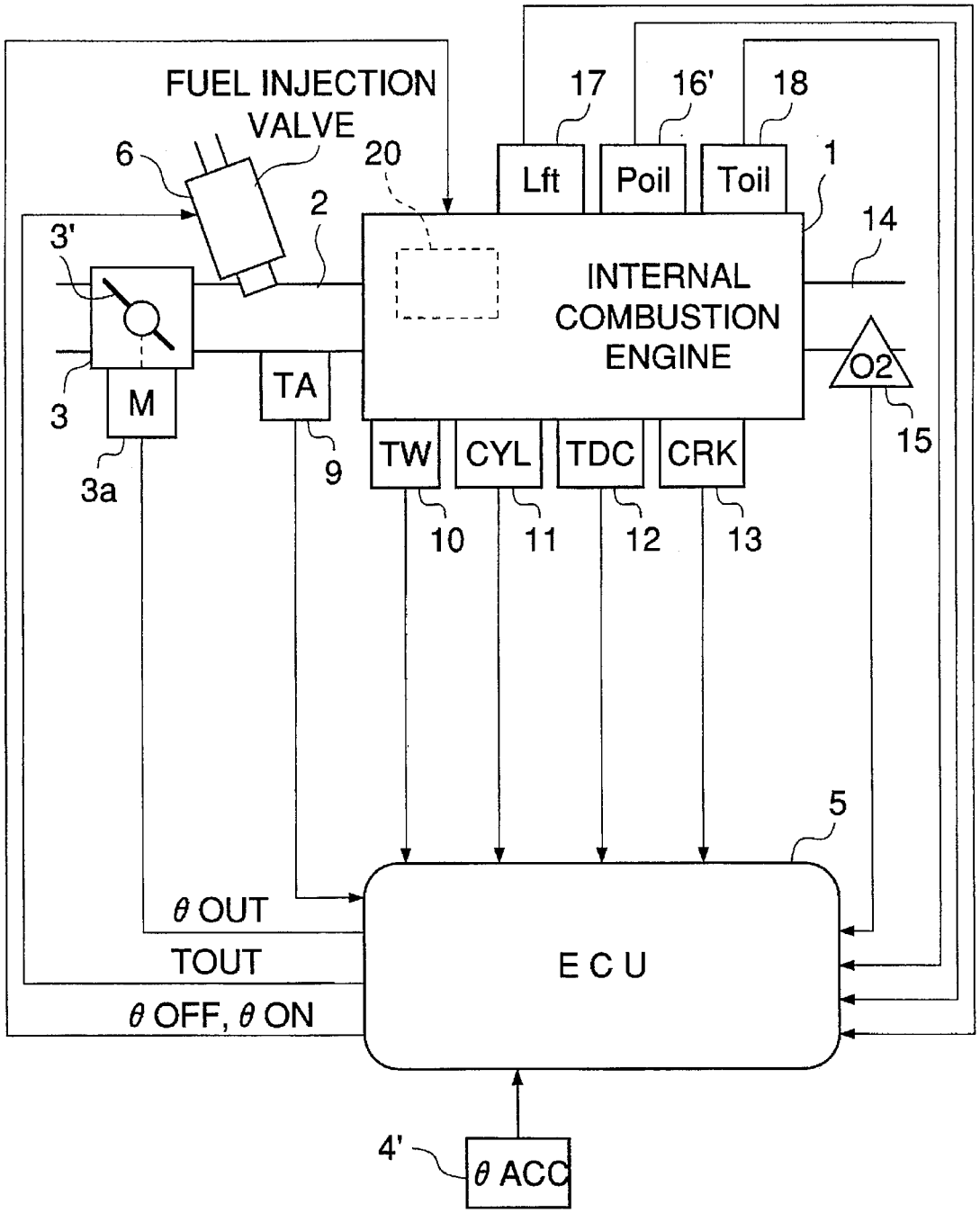
FIG. 5 is a schematic diagram showing the whole arrangement of an internal combustion engine and a control system therefor, according to a second embodiment of the invention.

FIG. 5 shows the whole arrangement of a control system for an internal combustion engine, according to a second embodiment of the invention. As shown in the figure, according to this embodiment, the engine 1 is provided with an oil hydraulic valve driving unit 20 for each cylinder, in place of the valve timing changeover mechanism 19 employed in the first embodiment. The oil hydraulic valve driving units 20 hydraulically drive intake valves and exhaust valves of the engine. The ECU 5 is connected to a solenoid, not shown, of the oil hydraulic valve driving unit 20, and supplies a control signal (θOFF and θON) thereto. In the intake pipe 2 of the engine, there is arranged a throttle body 3 accommodating a throttle valve 3' therein. A motor **3*a* is coupled to the throttle valve 3' for driving it in response to a control signal from the ECU 5 so as to control its valve opening. The throttle valve 3' is held at almost the maximum opening when the engine 1 is operating in normal operating conditions. With the throttle valve 3' thus held at almost the maximum opening, the valve opening period of the intake valve is changed by the oil hydraulic valve driving unit 20 to control an intake air amount supplied to the cylinder of the engine 1**.

Connected to the ECU 5 is an oil pressure sensor 16' which detects the pressure (Poil) of operating oil in the oil hydraulic valve driving unit 20, in place of the oil pressure sensor 16 in the first embodiment. Further connected to the ECU 5 are an oil temperature sensor 18 which senses the oil temperature Toil of the operating oil, a lift sensor 17 which senses the lift of the intake valve, and an accelerator petal opening sensor 4' which senses a stepping amount (θACC) of an accelerator pedal of a vehicle on which the engine is installed. Output signals from these sensors are supplied to the ECU 5.

Elements and parts other than those mentioned above are identical in construction and arrangement with those employed in the first embodiment of FIG. 1 and designated by identical reference numerals, and description thereof is omitted.

Figure 6:
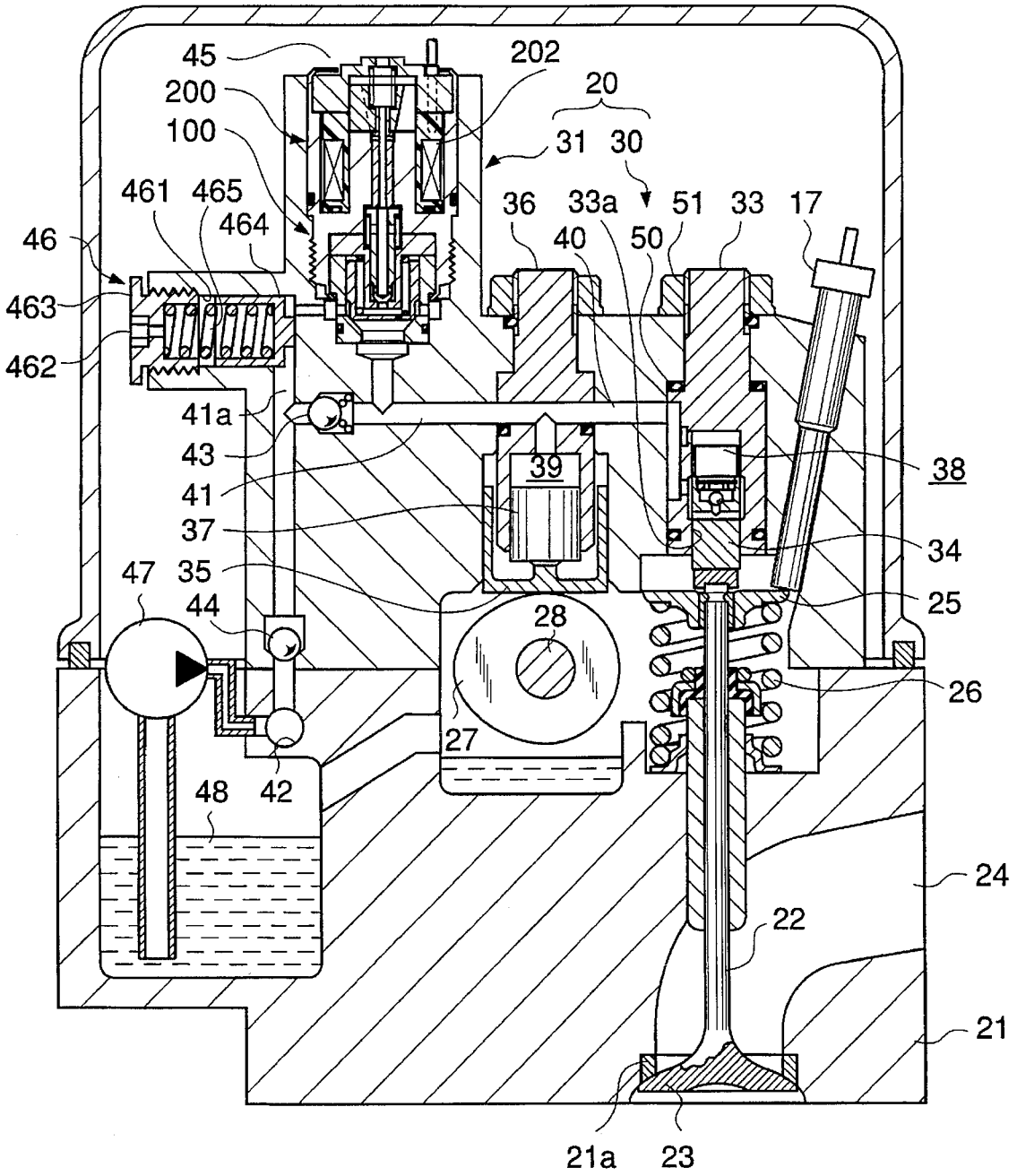
FIG. 6 is a cross-sectional view of an oil hydraulic valve driving unit provided in the engine in FIG. 5.

FIG. 6 shows the internal construction of the oil hydraulic valve driving unit 20 which is provided in each cylinder head 21 of the engine 1. The cylinder head 21 is formed therein with an intake valve port 23, one end of which opens into an upper space within a combustion chamber, not shown, of the engine 1 and the other end is in communication with an intake port 24. An intake valve 22 is slidably mounted in the cylinder head 21 for vertical reciprocating motion as viewed in the figure to open and close the intake valve port 23. A valve spring 26 is tautly mounted between a collar 25 of the intake valve 22 and the cylinder head 21 and urges the intake valve 22 upward as viewed in the figure or in a valve closing direction.

On the other hand, a camshaft 28 having a cam 27 formed integrally thereon is rotatably mounted in the cylinder head 21 at a left side of the intake valve 22. The camshaft 28 is coupled to a crankshaft, not shown, via a timing belt, not shown. The oil hydraulic valve driving unit 20 is interposed between the intake valve 22 and the cam 27 formed on the camshaft 28.

The oil hydraulic valve driving unit 20 is comprised of an oil hydraulic driving mechanism 30 disposed to downwardly urge the intake valve 22 against the force of the valve spring 26 to open or close the same in response to the profile of the cam 27, and an oil pressure release mechanism 31 disposed to cancel the urging force of the oil hydraulic driving mechanism 30 while the intake valve 22 is being opened to thereby close the intake valve 22 irrespective of the cam profile.

The oil hydraulic driving mechanism 30 is mainly comprised of a first cylinder body 33 secured to a block 32 mounted on or formed integrally with the cylinder head 21, a valve-side piston (valve driving piston) 34 slidably fitted in a cylinder bore 33*a* formed in the first cylinder body 33, with a lower end thereof resting against an upper end of the intake valve 22, an operating oil pressure chamber 38 defined by the first cylinder body 33 and the valve-side piston 34, a second cylinder body 36 secured to the block 32, a lifter 35 disposed in sliding contact with the cam 27, a cam-side piston 37 slidably fitted in a lower portion of the second cylinder body 36, with a lower end thereof resting against a bottom surface of the lifter 35, an oil pressure creating chamber 39 defined by the second cylinder body 36 and the cam-side piston 37, and an oil passage 40 extending between the oil pressure creating chamber 39 and the operating oil pressure chamber 38. The oil hydraulic driving mechanism 30 thus constructed operates according to the profile of the cam 27 to selectively open or close the intake valve 22 when the oil pressure in the operating oil pressure chamber 38 is above a predetermined value.

The lift sensor 17 is arranged in the block 32 at a location opposite to the collar 25 of the intake valve 22 to sense its lift. The lift sensor 17 is electrically connected to the ECU 5 to supply the same with a signal indicative of the sensed lift.

On the other hand, the oil pressure release mechanism 31 is mainly comprised of an oil passage 41 connecting between the oil passage 40 and an oil supply gallery 42, a spill valve 45 arranged across the oil passage 41, a feed valve 43 and a check valve 44 both arranged in the oil passage 41, and an accumulator 46 disposed to maintain oil pressure within an accumulator circuit 41*a* formed by the valves 43, 44 and the spill valve 45 at a predetermined value. The oil supply gallery 42 is connected to an oil pump 47 to supply oil pressure created by the oil pump 47 to the oil hydraulic driving valve units 20 of the engine cylinders. The oil pump 47 pressurizes operating oil in an auxiliary oil pan 48 provided in the cylinder head 21 to a value within a predetermined range of the oil pressure, and supplies the pressurized oil to the oil supply gallery 42. It may be so arranged that the oil supply gallery 42 is supplied with operating oil from an oil pan provided at a bottom portion of a crankcase, not shown, by means of an oil pump.

The spill valve 45 is comprised of a control valve section 100, and a solenoid driving section 200 for driving the control valve section 100.

The spill valve 45 is open, when a solenoid 202 of the solenoid driving section 200 is deenergized, whereas when the solenoid 202 is energized, the spill valve 45 is closed. The solenoid is electrically connected to the ECU 5 to be energized or deenergized by a control signal from the ECU 5.

The accumulator 46 is arranged in the accumulator circuit 41*a* to maintain oil pressure within the accumulator circuit 41*a* at a predetermined value. The accumulator 46 is comprised of a cylinder bore 461 formed in the block 32, a cap 463 having an air hole 462 formed therein, a piston 464 slidably fitted in the cylinder bore 461, and a spring 465 tautly interposed between the cap 463 and the piston 464.

The operation of the oil hydraulic driving mechanism 30 and the oil pressure release mechanism 31 constructed as above will now be described.

Figure 7:
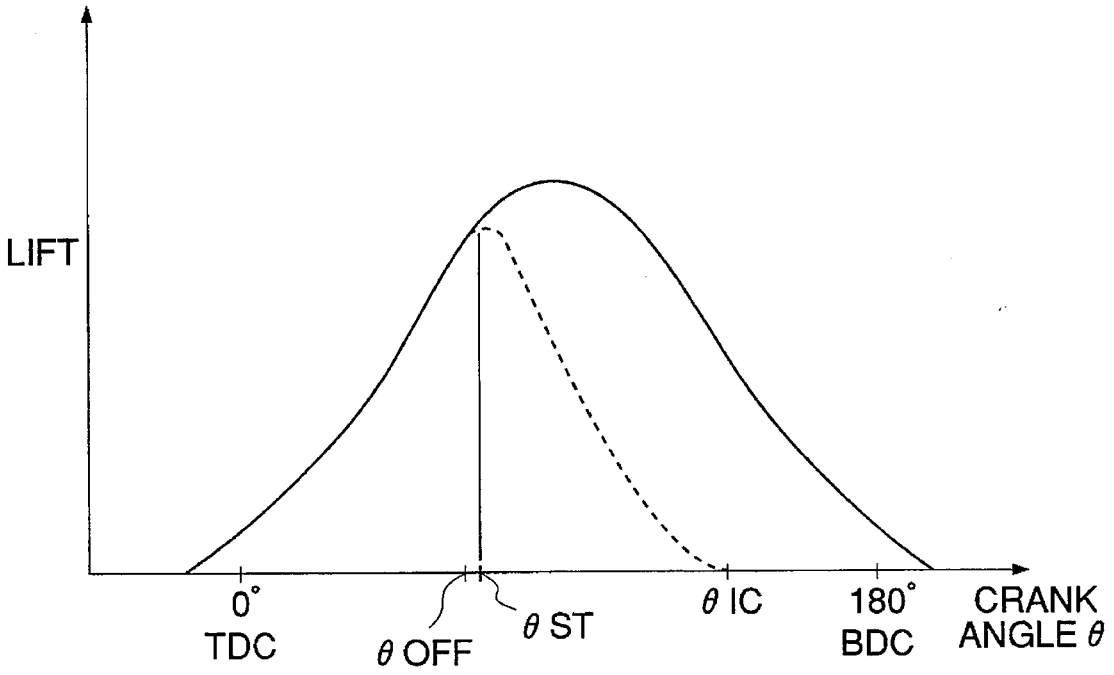
FIG. 7 is a graph useful in explaining operating characteristics (valve timing) of an intake valve in the engine in FIG. 5.

When the solenoid 202 of the spill valve 45 is energized by the control signal from the ECU 5, the spill valve 45 is closed so that the oil pressure within the oil pressure creating chamber 39, the oil passage 40 and the operating oil pressure chamber 38 of the oil hydraulic driving mechanism 30 is maintained at a high level (at a predetermined pressure value or more), whereby the intake valve 22 is alternately opened or closed in response to the profile of the cam 27. The valve operating characteristic (the relationship between the crank angle and the valve lift) obtained in this case is shown, by way of example, by the solid line in FIG. 7.

On the other hand, when the solenoid 202 of the spill valve 45 is deenergized by the control signal from the ECU 5 while the intake valve 22 is open, the spill valve 45 becomes open. As a result, the oil pressure within the operating oil pressure creating chamber 39, the oil passage 40 and the operating oil pressure chamber 38 of the oil hydraulic driving mechanism 30 decreases, whereby the intake valve 22 starts its closing motion, irrespective of the profile of the cam 27. The valve operating characteristic then obtained is such as shown by the broken line in FIG. 7. That is, in the figure, when the solenoid 202 is deenergized at a crank angle θOFF, the intake valve 22 begins to make a closing motion at a crank angle θST after a slight time delay from the crank angle θOFF and becomes completely closed at a crank angle θIC (hereinafter referred to as "the intake valve closing timing").

In this way, the intake valve 22 is controlled by the control signal from the ECU 5 such that it begins to make a closing motion when it is on the opening stroke, by rendering the oil hydraulic driving mechanism 30 inoperative. Therefore, the timing of valve closing start can be set to any desired timing, whereby it is possible to control the intake air amount supplied to the engine cylinders by the control signal from the ECU 5.

A similar oil hydraulic valve driving unit, not shown, is provided on the side of exhaust valves in this embodiment. Alternatively, there may be provided an ordinary type valve operating mechanism in which the exhaust valve is closed at a constant timing according to a cam profile, or a variable valve timing mechanism in which the valve opening/closing timing can be set to a plurality of different timings, similarly to the valve timing changeover mechanism employed in the first embodiment. In the following description, the valve closing timing on the exhaust valve side will be referred to as "exhaust valve closing timing θEC", as corresponding to the intake valve closing timing θIC on the intake valve side.

Figure 8A:
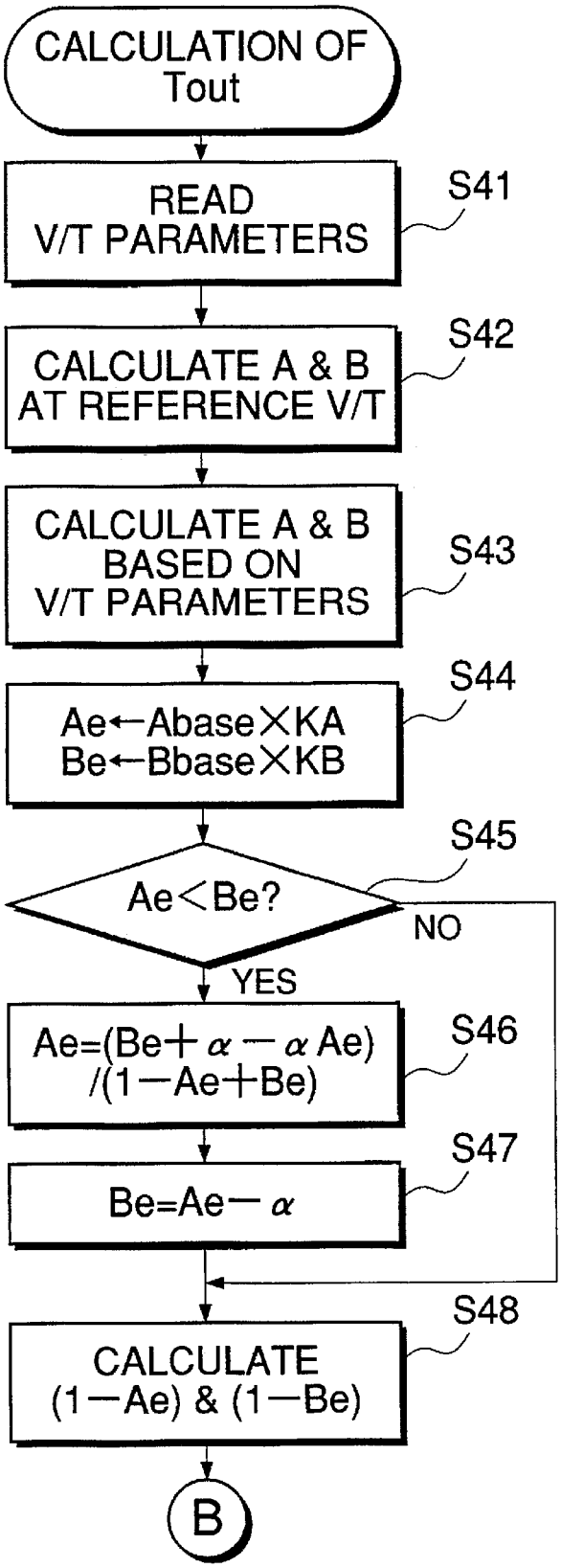
FIG. 8A is a flowchart showing a program for calculating a fuel injection period Tout, according to the second embodiment.
Figure 8B:
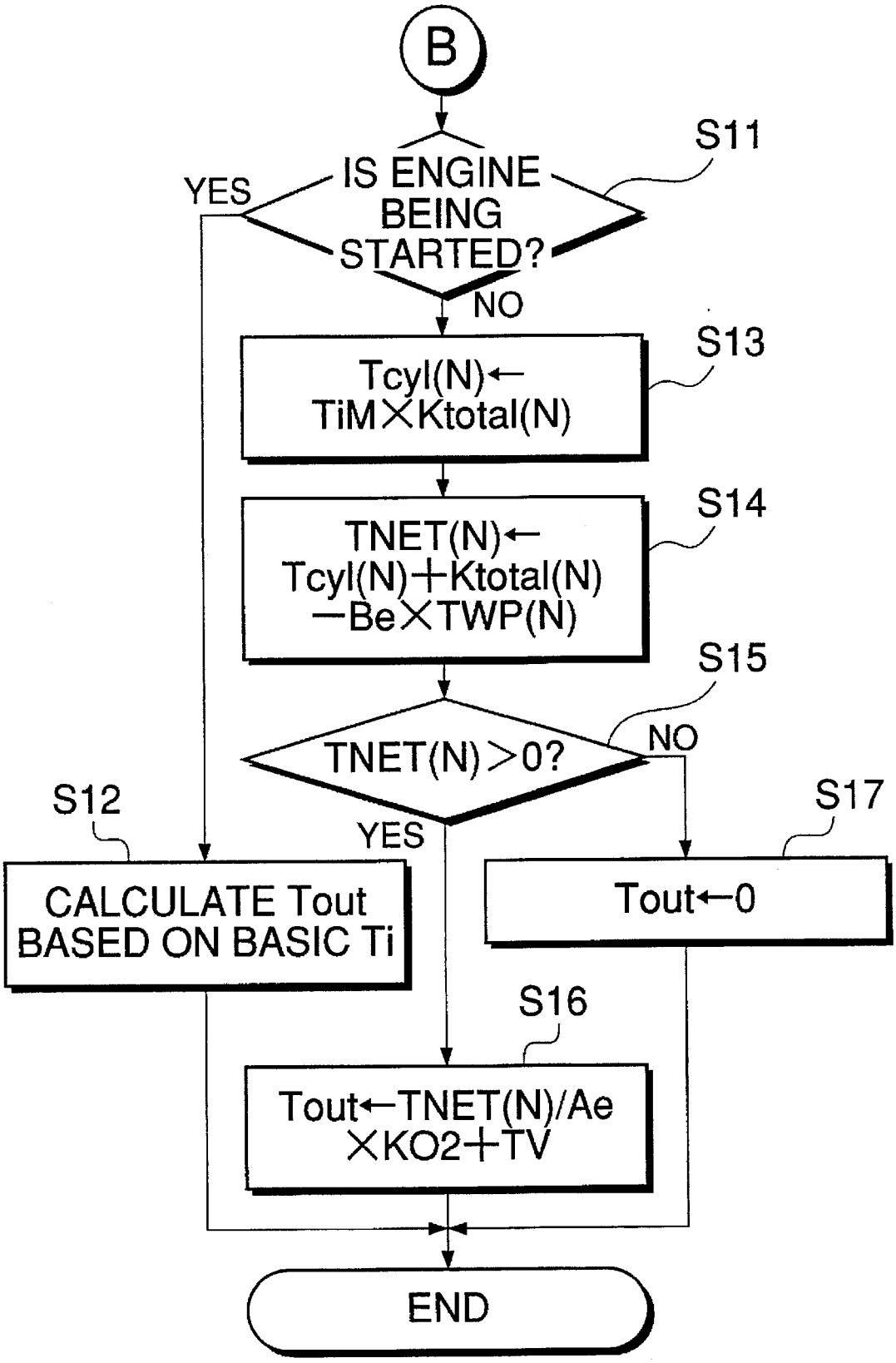
FIG. 8B is a continued part of the flowchart of FIG. 8A.

FIGS. 8A and 8B show a program for calculating the fuel injection amount Tout according to the second embodiment, which program corresponds to the one shown in FIGS. 2A and 2B.

At a step S41, valve timing parameters, i.e. intake valve closing timing θIC and exhaust valve closing timing θEC are read in. The θIC and θEC values to be read in may be actual values determined from lift values indicated by outputs from the lift sensor 17 and a lift sensor on the exhaust valve side, or calculated values determined by another routine in response to operating conditions of the engine.

Figure 9A:
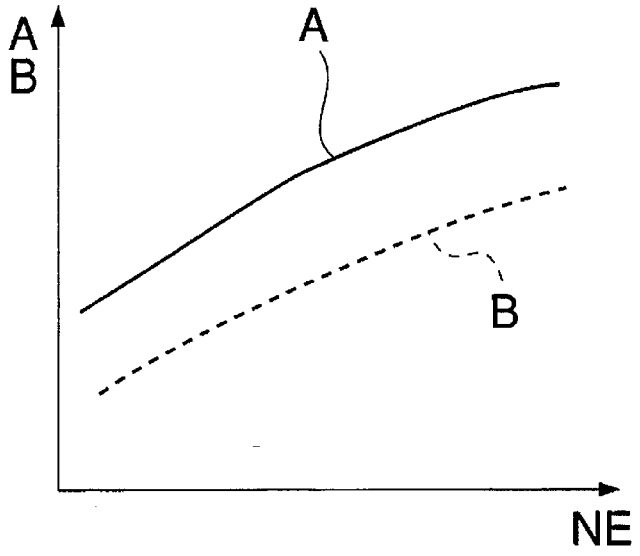
FIG. 9A shows a table for calculating the direct supply ratio A and the carry-off ratio B.
Figure 9B:
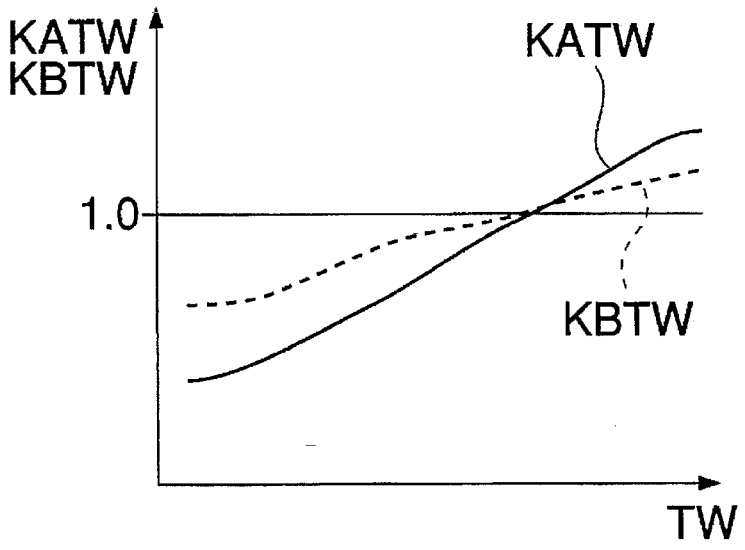
FIG. 9B shows a table for calculating correction coefficients for correcting the ratios A and B.

At a step S42, the direct supply ratio A and the carry-off ratio B are calculated by the use of an A table and a B table shown in FIG. 9A, based on the detected engine rotational speed NE. Then, coolant-dependent temperature correction coefficients KATW and KBTW are calculated based on the detected engine coolant temperature by the use of a KATW table and a KBTW table set in accordance with the engine coolant temperature TW as shown in FIG. 9B. The values of the A and B tables shown in FIGS. 9A and 9B are set to values to be obtained when the engine output assumes 50% of its maximum value at each value of the engine rotational speed. At the step S42, reference values Abase and Bbase of the direct supply ratio and the carry-off ratio are also calculated by the use of the following equations (10) and (11):

$$Abase=A\times KATW \quad (10)$$

$$Bbase=B\times KBTW \quad (11)$$

Figure 10A:
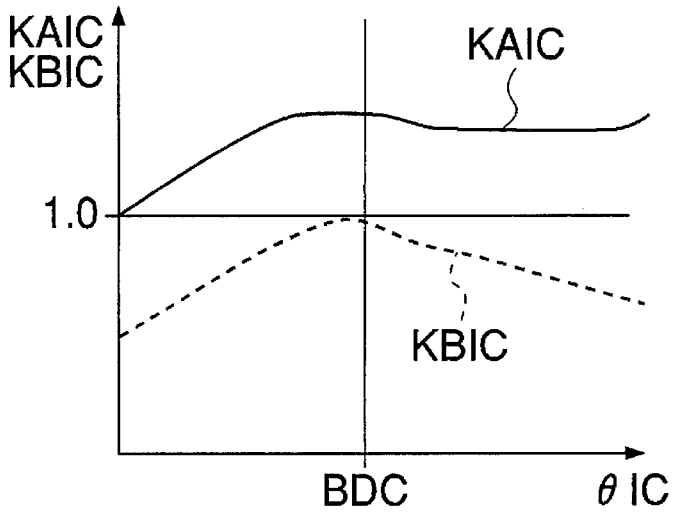
FIG. 10A shows a table for calculating correction coefficients for correcting the direct supply ratio A and the carry-off ratio B, in dependence on intake valve closing timing.
Figure 10B:
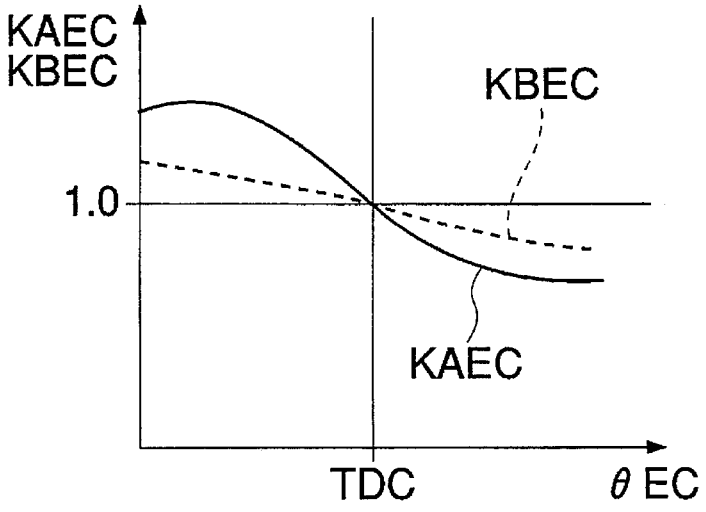
FIG. 10B shows a table for calculating correction coefficients for correcting the direct supply ratio A and the carry-off ratio B, in dependence on exhaust valve closing timing.

At a step S43, intake-side correction coefficients KAIC and KBIC for the direct supply ratio and the carry-off ratio are calculated by the use of a KAIC table and a KBIC table set in accordance with the closing timing θIC of the intake valve, as shown in FIG. 10A, and then, exhaust-side correction coefficients KAEC and KBEC are calculated by the use of a KAEC table and a KBEC table set in accordance with the closing timing θEC of the exhaust valve, as shown in FIG. 10B, followed by calculating reference value correction coefficients KA and KB by the use of the following equations (12) and (13). In this embodiment, the tables of FIGS. 10A and 10B are set such that as the θIC value or the θEC value increases or moves rightward as viewed in FIG. 10A or 10B, the valve opening period of the intake valve or the exhaust valve decreases (the θIC value moves leftward in FIG. 7, for instance):

$$KA=KAIC\times KAEC \quad (12)$$

$$KB=KBIC\times KBEC \quad (13)$$

At the next step S44, a corrected direct supply ratio Ae and a corrected carry-off ratio Be are calculated by the use of the following equations (14) and (15), and then the program proceeds to the step S7:

$$Ae=Abase\times KA \quad (14)$$

$$Be=Bbase\times KB \quad (15)$$

The steps S7–S17 in FIGS. 8A and 8B are identical with the steps S7–S17 in FIGS. 2A and 2B, description of which is therefore omitted.

The intake pipe-adherent fuel amount TWP(N) is calculated by the aforedescribed program in FIG. 3, also in this embodiment.

According to the present embodiment, to prevent satisfaction of the relationship of Ae<Be, the corrected direct supply ratio Ae and the corrected carry-off ratio Be are further corrected by the use of the equations (3) and (4) as described above. As a result, the Ae and Be values can be always maintained in the relationship of Ae>Be, and therefore the air-fuel ratio of the mixture can be controlled to a desired value in a stable manner. Besides, the direct supply ratio A and the carry-off ratio B are corrected in response to the closing timing of the intake and exhaust valves, which makes it possible to accurately estimate the intake pipe-adherent fuel amount and the carried-off fuel amount, irrespective of the closing timing of the intake and exhaust valves and hence accurately control the air-fuel ratio of the mixture supplied to the combustion chambers to desired values.

The methods of calculating the direct supply ratio A and the carry-off ratio B employed in the first and second embodiments described above are applicable to a valve control system which renders part of the intake valves and/or part of the exhaust valves inoperative when the engine is operating in a low load condition.

What is claimed is:

1. A control system for an internal combustion engine having an intake passage having an inner surface, comprising an electronic control unit including:

central processing means comprising (i) supply fuel amount-calculating means for calculating an amount of fuel to be supplied to said engine, based on operating conditions of said engine, (ii) direct supply ratio/carry-off ratio-determining means for determining a direct supply ratio and a carry-off ratio, based on operating conditions of said engine, said direct supply ratio being a ratio of a fuel amount directly drawn into said engine in a predetermined operating cycle of said engine to a fuel amount supplied into said intake passage in the same operating cycle, said carry-off ratio being a ratio of a fuel amount carried off said inner surface of said intake passage and drawn into said engine in said predetermined operating cycle of said engine to a fuel amount which adhered to said inner surface of said intake passage in an operating cycle immediately preceding said predetermined operating cycle, (iii) adherent fuel amount-estimating means for estimating an adherent fuel amount which is to adhere to said inner surface of said intake passage in said predetermined operating cycle of said engine, based on said direct supply ratio and said carry-off ratio, (iv) carried-off fuel amount-estimating means for estimating said fuel amount carried off said inner surface of said intake passage, based on said direct supply ratio and said adherent fuel amount, (v) supply fuel amount-correcting means for correcting said amount of fuel to be supplied, calculated by said supply fuel amount-calculating means, based on said adherent fuel amount estimated by said adherent fuel amount-estimating means and said carried-off fuel amount estimated by said carried-off fuel amount-estimating means, and (vi) direct supply ratio/carry-off ratio-correcting means for correcting said direct supply ratio and said carry-off ratio when said direct supply ratio and said carry-off ratio are in a predetermined relationship; and output means for outputting said amount of fuel corrected by said supply fuel amount-correcting means to fuel supply means for supplying fuel.

2. A control system as claimed in claim 1, wherein said predetermined relationship is satisfied when said carry-off ratio is larger than said direct supply ratio.

3. A control system as claimed in claim 1, wherein said direct supply ratio/carry-off ratio-correcting means corrects said direct supply ratio and said carry-off ratio by the use of the following equations:

$$Ae=(Be+\alpha-\alpha Ae)/(1-Ae+Be)$$

$$Be=Ae-\alpha$$

$$0<\alpha<1$$

where Ae represents said direct supply ratio, Be said carry-off ratio, and α a correction coefficient.

4. A control system as claimed in claim 3, wherein said correction coefficient α used in said equations is set to a fixed value in a range more than 0 and less than 1.

5. A control system as claimed in claim 1, wherein said engine includes at least one intake valve, at least one exhaust valve, and valve timing changing means for changing valve timing of at least one of said at least one intake valve and said at least one exhaust valve, said direct supply ratio/carry-off ratio-detecting means determining said direct supply ratio and said carry-off ratio, based on said valve timing of said at least one of said at least one intake valve and said at least one exhaust valve.

6. A control system for an internal combustion engine having an intake passage having an inner surface, comprising an electronic control unit including:

central processing means comprising (i) supply fuel amount-calculating means for calculating an amount of fuel to be supplied to said engine, based on operating conditions of said engine, (ii) direct supply ratio/carry-off ratio-determining means for determining a direct supply ratio and a carry-off ratio, based on operating conditions of said engine, said direct supply ratio being a ratio of a fuel amount directly drawn into said engine in a predetermined operating cycle of said engine to a fuel amount supplied into said intake passage in the same operating cycle, said carry-off ratio being a ratio of a fuel amount carried off said inner surface of said intake passage and drawn into said engine in said predetermined operating cycle of said engine to a fuel amount which adhered to said inner surface of said intake passage in an operating cycle immediately preceding said predetermined operating cycle, (iii) supply fuel amount-correcting means for correcting said amount of fuel to be supplied, calculated by said supply fuel amount-calculating means, based on said direct supply ratio and said carry-off ratio determined by said direct supply ratio/carry-off ratio-determining means, and (iv) direct supply ratio/carry-off ratio-correcting means for correcting said direct supply ratio and said carry-off ratio when said direct supply ratio and said carry-off ratio are in a predetermined relationship; and output means for outputting said amount of fuel corrected by said supply fuel amount-correcting means to fuel supply means for supplying fuel.

7. A control system as claimed in claim 6, wherein said predetermined relationship is satisfied when said carry-off ratio is larger than said direct supply ratio.

* * * * *